US006090494A

United States Patent [19]

Rao

[11] Patent Number: 6,090,494

[45] Date of Patent: Jul. 18, 2000

[54] PIGMENTED POLYAMIDE SHAPED ARTICLE INCORPORATING FREE POLYESTER ADDITIVE

[75] Inventor: Sundar Mohan Rao, Chattanooga, Tenn.

[73] Assignee: E. I. du Pont de Nemours and Company, Wilmington, Del.

[21] Appl. No.: 09/037,110

[22] Filed: Mar. 9, 1998

[51] Int. Cl.[7] ..... B32B 5/16

[52] U.S. Cl. ..... 428/475.2; 524/538; 524/539; 524/99; 524/357; 527/243; 527/244

[58] Field of Search ..... 524/538, 357, 524/539, 99; 527/243, 244; 428/475.2

[56] References Cited

U.S. PATENT DOCUMENTS

| | | | |
|---|---|---|---|
| 3,369,057 | 2/1968 | Twilley | 260/857 |
| 3,549,741 | 12/1970 | Caison et al. | 264/210 |
| 3,692,867 | 9/1972 | Mayer et al. | 260/857 PE |
| 4,518,744 | 5/1985 | Brody | 525/184 |
| 5,213,733 | 5/1993 | Hwu et al. | 264/78 |
| 5,290,850 | 3/1994 | Shridharani et al. | 524/607 |

FOREIGN PATENT DOCUMENTS

| | | | |
|---|---|---|---|
| 0 411 493 A2 | 2/1991 | European Pat. Off. | D01F 8/12 |
| 0 794 222 A2 | 9/1997 | European Pat. Off. | C08K 9/04 |
| 0373 655 | 6/1999 | European Pat. Off. | D01F 6/92 |
| 1 126 126 | 9/1968 | United Kingdom | D01F 7/04 |
| WO 92 08828 | 5/1992 | WIPO | D01F 6/80 |
| WO 95 25187 | 9/1995 | WIPO | D01F 1/04 |
| WO 97/11830 | 4/1997 | WIPO | B29C 47/00 |

OTHER PUBLICATIONS

Kato Tetsuya, Production Of Polyamide Mixed Fiber With Improved Properties, *Patent Abstract*, 5, 1, Dec. 22, 1980.

*Primary Examiner*—Robert Dawson
*Assistant Examiner*—Kuo-Liang Peng

[57] ABSTRACT

A shaped article is disclosed which is formed from a polymer mixture of polyamide polymer, pigment dispersed in a polymeric carrier and about one-half to nine percent free polyester based on the weight of the polymer mixture. A process for making the shaped article is also disclosed, wherein the polymer mixture is melted, mixed and formed into the shaped article. The invention is especially suited for use in forming multifilament yarn, where the use of the invention facilitates the spinning of yarns containing difficult-to-spin pigments. The invention may be advantageously employed using conventional polyamide melt-spinning techniques.

7 Claims, 2 Drawing Sheets

PIGMENTED POLYAMIDE SHAPED ARTICLE INCORPORATING FREE POLYESTER ADDITIVE

BACKGROUND OF THE INVENTION

1. Field of the Invention

The invention relates generally to a process for making shaped articles from a base polymer containing additives, and in particular to a process for adding a polyester polymer to a pigmented polyamide base polymer and spinning the polymer mixture into a multifilament yarn.

2. Description of the Prior Art

Pigmented polyamide yarns have been commercially available for many years.

Pigments are added to molten polyamide base polymer, either directly or as dispersed in a polymeric carrier material. The polymeric carrier material facilitates the distribution of the pigment in the polyamide polymer. Carriers commonly used with nylon 6,6 base polymer include nylon 6 and 6/6,6/6,10 terpolymer. In general, the melting temperature of the polymeric carrier should be lower than that of the base polymer. The pigment dispersed in carrier material is blended with the base polyamide, melted in an extruder and processed into a shaped article. In the finished article, the polymeric carrier material remains "bound" to the pigment particles; that is, the polymeric carrier material remains intimately associated with the pigment particles, and is not detectable as a "free," separate entity, "unbound" from pigment particles. Such yarns have found particular suitability as carpet yarns, allowing carpets to be produced without the need for dyeing. Furthermore, the yarn color is inherent in the polymer, making the yarn more resistant to light and the effects of chemical treatments than dyed nylon yarns.

One disadvantage of spinning fiber from pigmented polymer is that some pigments make the polymer difficult to spin. These difficult-to-spin pigments include Phthalo Green, Phthalo Blue, Channel Black, Antimony Chrome Titanate, Anthraquinone, Perylene Red, Cobalt Blue, Lamp Black, Carbozol Violet, Quinacridone, Indanthrone Blue and blends thereof. These pigments can agglomerate resulting in spinning breaks, or act as nucleating agents resulting in rapid crystallization of polyamide and thus high draw tension and spinning breaks. Some of these pigment particles are abrasive or large enough to cause spinning breaks. Other related spinning problems are poor draw before hot rolls, excessive yarn wraps on feed roll and broken filaments.

It is known to combine polyester and polyamide polymers and spin the polymer mixture into a multifilament yarn. U.S. Pat. No. 3,549,741 (Caison et al.) is representative of such a process. This patent discloses the making of a carpet yarn from a polymer mixture containing a polyamide base polymer and ten percent (10%) to forty percent (40%) by weight polyester based on the weight of the polymer mixture. The polymer mixture may optionally include various additives, including inorganic and organic pigments. In the yarn produced by this process, the polyester may be detected as a "free," separate entity, "unbound" from pigment particles.

The process described in the Caison et al. patent requires certain non-conventional nylon spinning components, namely, an unusually large spinneret capillary cross-sectional area (in excess of $7\times10^{-4}$ square inches) and a level of attenuation of the filaments that is considerably above normal (70 to 120 versus 40 to 50). The increased level of attenuation of the filaments is accomplished by the combined effects of capillary size, attenuation of the molten filament and drawing of the solidified filament. Such large spinneret capillary sizes and such increased level of attenuation distinguish the process of Caison et al. from a conventional nylon melt-spinning process.

In view of the foregoing, it is believed desirable to spin nylon yarn from polymer having difficult-to-spin pigments therein with an acceptable level of spinning breaks and broken filaments. Furthermore, it is believed desirable for such a process to use conventional nylon melt-spinning techniques.

SUMMARY OF THE INVENTION

The invention relates to a pigmented polyamide shaped article, such as a multifilament yarn, comprising the following components: (i) a polyamide polymer, (ii) a pigment dispersed in a polymeric carrier, and (iii) about one-half (0.5) to about nine (9) percent free polyester by weight of the components (i) plus (ii) plus (iii). More preferably, the free polyester is about three (3) to about five (5) percent by weight of the components (i) plus (ii) plus (iii). The free polyester is selected from the group consisting of poly (ethylene terephthalate), poly(trimethylene terephthalate), poly(tetramethylene terephthalate) and copolymers and blends thereof, with poly(ethylene terephthalate) being most preferred. The polyamide polymer is selected from the group consisting of nylon 6, nylon 6,6 and copolymers and blends thereof.

The invention also relates to a process for making a pigmented polyamide shaped article comprising the steps of:

a) forming a polymer mixture by combining components:
   (i) a polyamide polymer,
   (ii) a pigment dispersed in a polymeric carrier, and
   (iii) about one-half (0.5) to about nine (9) percent free polyester by weight of components (i) plus (ii) plus (iii),
b) melting and mixing the polymer mixture, and
c) extruding and solidifying the polymer mixture into the shaped article.

Another aspect of the invention relates to an improved process for making a pigmented polyamide multifilament yarn using conventional nylon melt-spinning techniques. The improved process comprises the steps of:

a) forming a polymer mixture by combining components:
   (i) a polyamide polymer,
   (ii) a pigment dispersed in a polymeric carrier, and
   (iii) about one-half (0.5) to about twenty (20) percent free polyester by weight of components (i) plus (ii) plus (iii),
b) melting and mixing the polymer mixture, and
c) extruding the polymer mixture through a spinneret to form filaments.

By "conventional nylon melt-spinning techniques" is meant using conventional melt-spinning components to extrude polymer (that is, spinnerets having capillary cross-sectional areas in the range from about $3\times10^{-4}$ to $12\times10^{-4}$ square inches per capillary), solidifying the extruded filaments using air or liquid, and drawing the filaments over draw rolls at a level of attenuation of 40 to 50 (measured in accordance with the formula Attenuation=SA/q).

BRIEF DESCRIPTION OF THE DRAWINGS

The invention will be more fully understood from the following detailed description, taken in connection with the accompanying drawings which form a part of this application, and in which.

DETAILED DESCRIPTION OF THE INVENTION

The invention is useful in the production of a pigmented polyamide shaped article, particularly a pigmented nylon multifilament yarn. The invention is most suited for the production of such yarns by conventional nylon melt-spinning processing.

Figure 1:
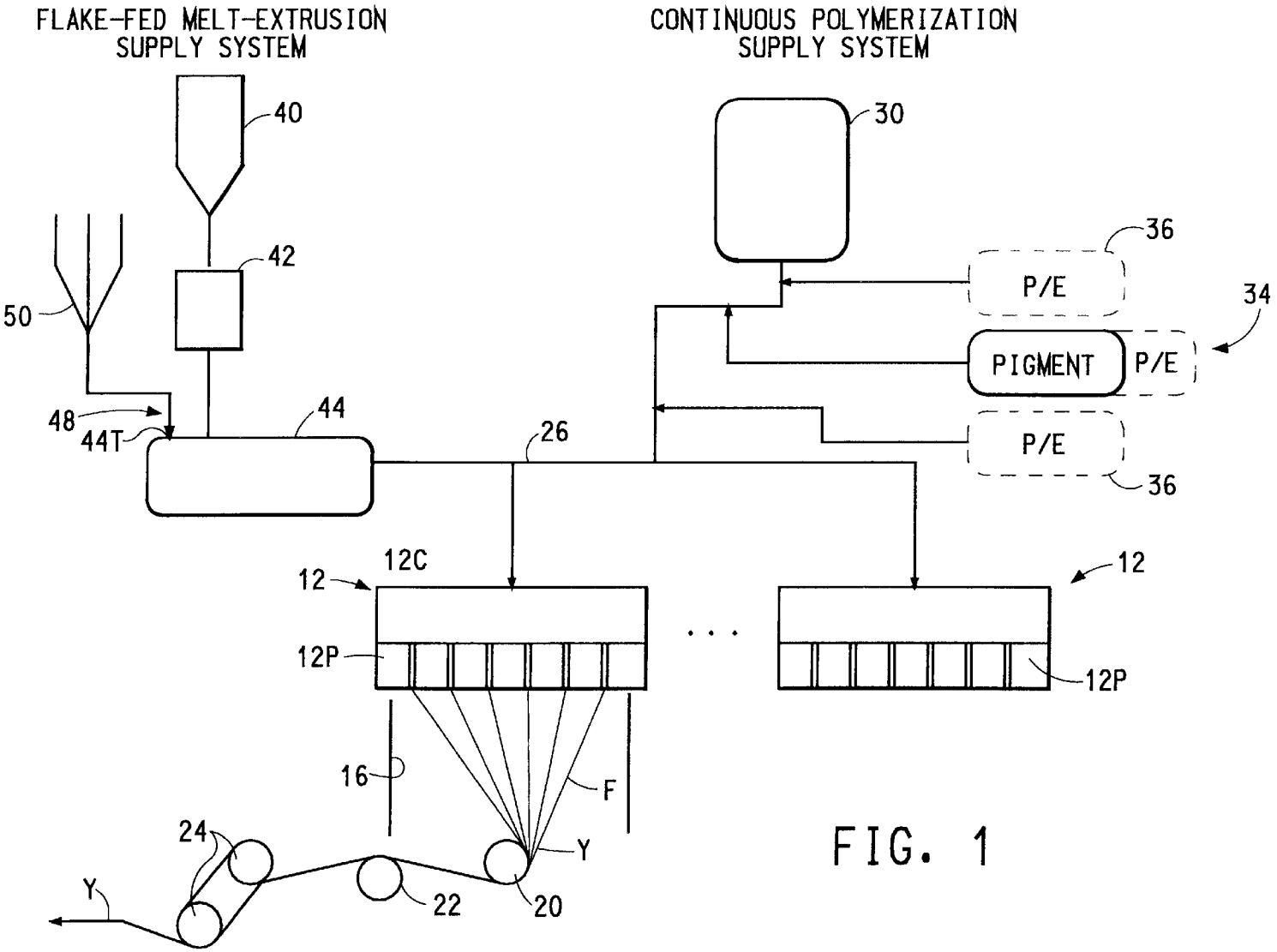
FIG. 1 is a schematic representation of the process of the invention.

FIG. 1 is a highly stylized diagrammatic illustration of an apparatus 10 for producing a thermoplastic polymer yarn Y. The apparatus 10 includes one or more spin packs 12 each including a spinneret plate 12P having capillaries 12C therethrough. The capillaries 12C of the spinneret plate 12P may be configured to impart any desired shape to the filaments F of the yarn Y produced. Polymer is supplied to the spin pack 12 from a transfer line 26. Any polyamide polymer able to be spun into yarn or other shaped articles may be used. Preferably, the polyamide is selected from nylon 6, nylon 6,6, and copolymers and blends thereof. The polyamide has a formic acid relative viscosity in the range of thirty (30) to one hundred fifty (150). The polyamide may also be selected from nylon 6,12, nylon 4,6, nylon 6/I/T, nylon 6,10, nylon 12,12, nylon 12, nylon 6,9, nylon 11, and copolymers and blends thereof. These polyamides may also contain known additives including flame retardants, antimicrobial agents, antioxidants, nucleating agents, antistatic agents, conductivity enhancers, adhesion promoting agents, lubricants, processing aids, stabilizers, fluorescent agents and brighteners, cross linking agents and antisoiling additives. Shaped articles other than yarn may also contain fillers and glass fibers as additives.

When used to make a pigmented multifilament nylon yarn, especially bulked continuous filament yarn, it may be preferable to include certain known comonomers in the base polyamide polymer. These include 5-sulfoisophthalic acid, isophthalic acid, terephthalic acid, 2-methyl 1,5-pentamethylene diamine and blends thereof. These comonomers improve the ability to spin a pigmented polyamide polymer by reducing the crystallization rate of the pigmented polymer. These comonomers are preferably added within the range of one-quarter percent (0.25%) to thirty percent (30%) by weight of the fiber. 5-sulfoisophthalic acid is particularly suited for use in carpet fiber since it increases the stain resistance of the polymer.

Nylon polymer suitable for spinning into filaments may be formed and delivered to the transfer line 26 in either of two well-known supply systems. According to one supply system, known as the "continuous polymerization" system, the polymer may be formed from its ingredients by continuous polymerization in a set of vessels 30 designed to maintain the conditions such as temperature and pressure required to build the nylon polymer to the desired molecular weight. According to another supply system, known as the "flake-fed melt-extrusion" system, nylon polymer pellets may be fed from a supply hopper 40, and, via a conditioner 42, into the throat of a screw-melter extruder 44. The conditioner 42 serves to hold the polyamide polymer at a certain temperature for a specified residence time in order to increase the relative viscosity. In the extruder 44, the relative viscosity of the nylon is further increased to the desired level.

In either case the polymer is then compounded with additives or pigment concentrates and pumped and transported through the transfer line 26 to the spin pack 12. The polymer must be filtered prior to being extruded into filaments; metal fines and/or sand immediately prior to the spinneret plate 12P are commonly used to accomplish this.

The polymer must be well mixed before being delivered to the spin pack 12. This may be accomplished by mixing elements included within the transfer line 26. Suitable mixers for this purpose include static mixers, such as those available from Chemineer-Kenics, Incorporated (North Andover, Mass.) and Koch Engineering Company, Incorporated (Wichita, Kans.), and dynamic mixers, such as those available from Barmag AG (Remscheid, Germany).

After the filaments F are extruded from the spinneret plate 12P, they are solidified by a flow of cooling fluid in a quench chamber 16. After solidifying the filaments F, finish oil is applied to the yarn Y, as by the roller 20, to aid in further processing. The yarn Y is then passed over a feed roll 22 which advances the yarn to a set of draw rolls 24. After being drawn the yarn Y may be subjected to optional further processing, such as further drawing in a process for high tenacity yarns, or impinging with air or steam in an impingement jet in a process for bulked continuous or textured yarn. Finally, the yarn Y is packaged for sale or further processing, typically by winding it onto a tube.

A pigment suitable for use in the invention is preferably in the form of pigment concentrate pellets, which comprises pigment particles dispersed within a polymeric carrier material. The polymeric carrier material facilitates the distribution of the pigment throughout the volume of the polyamide polymer. Pigments for use in the invention include titanium dioxide, organic pigments, inorganic pigments and combinations thereof. Pigments that have been found to be particularly troublesome in the sense that they make polymers in which they are incorporated difficult to spin include Phthalo Green, Phthalo Blue, Channel Black, Antimony Chrome Titanate, Anthraquinone, Perylene Red, Cobalt Blue, Lamp Black, Carbozol Violet, Quinacridone, Indanthrone Blue, either alone, blended among themselves, and/or blended with other (less difficult-to-spin) pigments and/or additives.

As used in this application, the term "conventional nylon melt-spinning techniques" is meant to include at least (1) using conventional melt-spinning components (that is, spinneret plates 12P having capillary 12C cross-sectional areas in the range from about $3\times10^{-4}$ to $12\times10^{-4}$ square inches per capillary) to extrude polymer, (2) solidifying the extruded filaments using air or liquid in the quench chamber 16, and (3) drawing the yarn Y over draw rolls 24 at a level of attenuation of 40 to 50, as measured in accordance with the formula:

$$\text{Attenuation}=SA/q, \quad (1)$$

where, S is the speed of the feed roll 22,

A is the cross-sectional area of the capillary 12C, and q is the volumetric throughput per capillary 12C.

According to the present invention, polyester polymer is added to the polyamide base polymer to form a polymer mixture which is then delivered to the spin pack 12. Suitable polyesters for use as the additive polymer include poly (ethylene terephthalate), poly(trimethylene terephthalate), poly(tetramethylene terephthalate) and copolymers and blends thereof, with poly(ethylene terephthalate) being most preferred. The polyester should have low moisture content, a melting temperature lower than that of the polyamide base polymer, and an intrinsic viscosity in the range of 0.35 to 1.2 for the preferred embodiment.

The polyester may be recycled from post-industrial waste from fiber or film operations, or post-consumer waste such as poly(ethylene terephthalate) bottle resin. The nylon polymer used may also have recycle content.

The type of nylon supply system used will determine where the polyester should be added. In the case of the continuous polymerization system, the polyester is melted and injected through an injection valve at high pressure into the transfer line 26 carrying the polyamide polymer melt. As indicated at reference character 34, the polyester ("P/E") may be injected together with the pigment at the same location in the transfer line 26. Alternatively, the polyester may be injected at a location 36 spaced either upstream or downstream from the location at which the pigment is added.

In a flake-fed melt-extrusion system, the polyester is added in pellet form to the polyamide base polymer at the throat or the inlet 44T of the screw-melter extruder 44. As indicated by reference character 48, the nylon pellets, pigment concentrate pellets and other optional additives may be fed into the extruder at the same location. Any suitable known technology, such as a gravimetric feeder 50 or a set of gravimetric feeders, also known as a multi-feeder, may be used. A suitable multi-feeder for use in the present invention is disclosed in International Application PCT/US96/15339 published as WO 97/11830 on Apr. 3, 1997.

Figure 2:
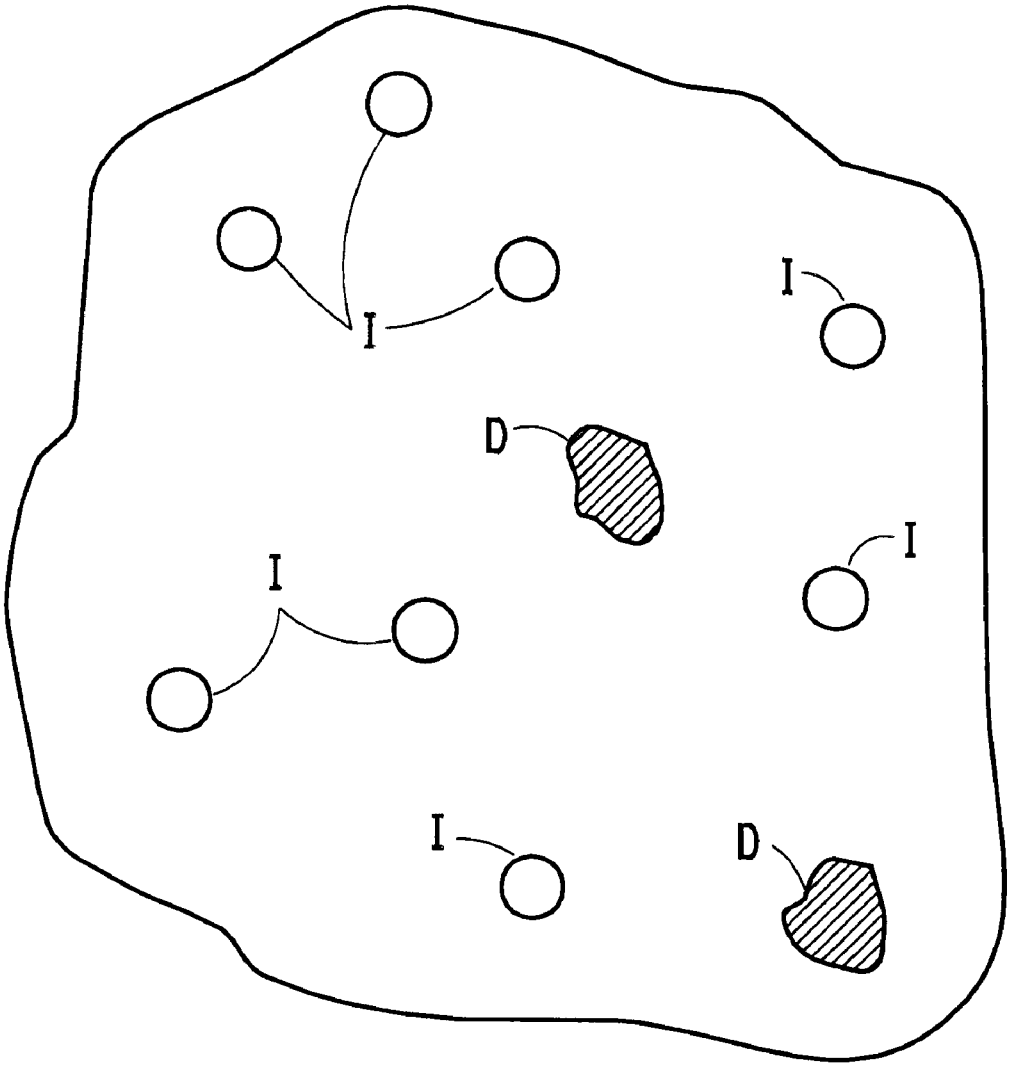
FIG. 2 is a drawing representing a photographic image of a cross-section of a pigmented polyamide fiber of the present invention.

Shown in FIG. 2 is a highly stylized drawing representation of a photographic image of a portion of a cross-section of a filament of a yarn produced in accordance with the process of the present invention. The photograph used as the basis of the drawing was taken using a transmission electron microscope at 54000× magnification, although no particular scale should be inferred from the drawing. In the representation of the shaped article as shown in FIG. 2, the polyamide material and the pigment and its polymeric carrier meld together and are indistinguishable from each other. The polymeric carrier material remains "bound" to the pigment particles, that is, the polymeric carrier material remains intimately associated with the pigment particles, and is not detectable as separate from the pigment. These materials form what could be analogized to a background "sea" S in which discrete circular "islands" I and dark specks D of material are visible. The dark specks D represent pigment particles with which the associated polymeric carrier is not visible. The islands I represent masses of "free," additive polyester introduced into the base polymer in accordance with the process of the invention. By "free polyester" is meant polyester that appears in the shaped article as a separate entity that is "unbound" from, or not associated with, pigment particles. The cross-sectional islands I of free polyester have a diameter of between about 0.01 and about 5 microns.

In one embodiment of the invention, the amount of free polyester added to the polyamide base polymer is about 0.5 to about 9% of the sum of the weights of the (i) polyamide polymer component, (ii) the pigment component, including its polymeric carrier, and (iii) the free polyester component. It is noted that the weight of the polyamide polymer component would include any additive(s) present within the polymer. More preferably, the amount of free polyester added to the polyamide base polymer is about 3 to about 5% of the sum of the weights of the (i) polyamide polymer component, (ii) the pigment component, including its polymeric carrier, and (iii) the free polyester component. It is again noted that the weight of the polyamide polymer component would include any additive(s) present within the polymer. In general, the amount of free polyester to be added will vary depending on the desired end use properties (such as luster, color, resiliency, soiling, stain resistance and light fastness) and operating considerations (such as break performance, uniformity and ability to spin with the specific pigments being used). If the process for making a multifilament yarn uses spinneret capillary sizes, quenching, and levels of attenuation that are encompassed within a "conventional nylon melt-spinning techniques" (as herein described), then the range of polyester addition may be between about 0.5 and about 20% of the sum of the weights of the (i) polyamide polymer component, (ii) the pigment component, including its polymeric carrier, and (iii) the free polyester component.

Since FIG. 2 is a cross-section, the masses of free polyester appear as two-dimensional members. However, it should be appreciated that in the actual shaped article, e.g., the yarn, the free polyester in fact manifests itself as striated masses that extend axially along each polyamide filament of the yarn.

It has been found that by adding the polyester in the ranges above described the spinning of polyamide polymer containing the above-enumerated difficult-to-spin pigments is facilitated.

The invention may be applied to making yarns using various draw ratios and therefore various yarn tenacity levels to meet end use needs, for example, carpet fibers made using a draw ratio of 2.5 to 3.0 and light denier industrial yarns made using a draw ratio of 3 to 5.

The invention need not be limited to yarns made from a single polymer phase. Multi-phase structures such as bicomponent yarns can be made with one or more phases forming the yarn being made from a pigmented polyamide base polymer containing free polyester according to the invention. It should be understood that the foregoing percentage limitations applicable to the free polyester are determined with reference to the weight of the phase containing the polyamide polymer component, the pigment component and the free polyester component.

TEST METHODS

Percent Draw

Yarn speed is measured using laser doppler velocimetry at a location about one-half inch prior to the draw rolls. The measured speed is divided by the draw roll speed to obtain percent draw.

EXAMPLES

In the examples and controls herein described, the following process for melt-spinning a pigmented polyamide yarn was used, unless otherwise specified:

Pellets of nylon 6,6 copolymer or terpolymer were conditioned for six hours in a solid phase polymerization vessel (conditioner) to increase the relative viscosity and reduce the moisture content of the polymer. The polymer pellets were then fed using a gravimetric feeder into the throat of a 40 millimeter twin screw extruder supplied by Berstroff Corporation, Charlotte, N.C. Also added at the throat of the extruder were pigment concentrate pellets and copper concentrate pellets. The copper concentrate pellets contained 23.6% CuI/KBr dispersed in nylon 6, and were added to result in 60 parts per million of copper in the yarn. The residence time of the polymer and additive pellets in the extruder was about 30 to 45 seconds. The molten polymer was pumped by a metering gear pump supplied by Zenith Pumps, Sanford, N.C., at a pressure of about 1500 pounds per square inch into a transfer line which delivered the polymer to a spinneret for extrusion into multifilament yarn having a filament linear density of 17 denier and a yarn linear density of 1235 denier. The transfer line included static mixers for blending the molten polymer. The polymer had a residence time in the transfer line of about 3.5 minutes. After being extruded through the spinneret, the filaments were quenched with air having a flow rate of 300 cubic feet per minute and a temperature of 50 degrees Fahrenheit. A primary finish was applied to the yarn. The yarn was then passed over a feed roll and set of draw rolls having speeds such that the draw ratio was 2.73. The temperature of the draw rolls was 175 degrees C. The drawn yarn was bulked in a bulking jet with air at 200 degrees C. and 125 pounds per square inch pressure. The bulked yarn was allowed to relax on a set of let-down rolls and finally wound onto a tube to form a yarn package.

Control 1

The nylon 6,6 copolymer pellets contained 3% by weight 5-sulfoisophthalic acid, and the nylon pellets were conditioned at 198 degrees C. The pigment concentrate used was Phthalo Green pigment dispersed at a loading of 25% in a carrier of nylon 6 and Elvamide® terpolymer of nylon 6, nylon 6,6 and nylon 6,10, available from E. I. Du Pont de Nemours and Company, Incorporated, Wilmington, Delaware. The pigment concentrate was added at a rate to provide 0.3% pigment in yarn.

The spinneret used resulted in a yarn having four axial voids and a generally square cross-sectional shape.

Poor spinning performance was observed, meaning many filament breaks, and wraps around the feed roll and draw rolls. Very little acceptable yarn could be collected as a result.

The speed of the yarn was measured at a point just prior to passing over the draw rolls to determine the percent draw, or how close to fully drawn the yarn is. The more fully drawn the yarn is before reaching the draw rolls, the better the spinning performance. The percent draw was determined to be 31%.

Example 1

The process of Control 1 was used, with the addition of 9% poly(ethylene terephthalate) by weight of the sum of the weights of the polyamide polymer component, the pigment component and the free polyester component. The poly (ethylene terephthalate) was added as pellets containing 0.1% anatase TiO2, added at the throat of the extruder using a gravimetric feeder.

No difficulty was experienced in spinning the yarn, i.e., there were neither filament breaks nor wraps on feed rolls or draw rolls. There was no significant change in melt viscosity as measured by the differential pressure across the transfer line or by the pack pressure. The percent draw was determined to be 42.0%.

Control 2

The nylon 6,6 copolymer pellets contained 1.25% by weight 5-sulfoisophthalic acid, and the nylon pellets were conditioned at 193 degrees C. The pigment concentrate used was Phthalo Green pigment dispersed at a loading of 25% in nylon 6/Elvamide carrier. The pigment concentrate was added at a rate to provide 0.3% pigment in yarn.

The spinneret used resulted in a yarn having four axial voids and a generally square cross-sectional shape.

Poor spinning performance was observed, with many filament breaks, and wraps around the feed roll and draw rolls. Very little acceptable yarn could be collected as a result. The percent draw was determined to be 33.1%.

Example 2

The process of Control 2 was used, with the addition of 9% poly(ethylene terephthalate) by weight of the sum of the weights of the polyamide polymer component, the pigment component and the free polyester component. The poly (ethylene terephthalate) was added as pellets containing 0.1% anatase TiO2, added at the throat of the extruder using a gravimetric feeder. No difficulty was experienced in spinning the yarn, i.e., there were neither filament breaks nor wraps on feed rolls or draw rolls. There was no significant change in melt viscosity as measured by the differential pressure across the transfer line or by the pack pressure. The percent draw was determined to be 40.5%.

Example 3

The process of Example 2 was used, except the addition rate of the poly(ethylene terephthalate) was 6% by weight of the sum of the weights of the polyamide polymer component, the pigment component and the free polyester component.

No difficulty was experienced in spinning the yarn, i.e., there were neither filament breaks nor wraps on feed rolls or draw rolls. There was no significant change in melt viscosity as measured by the differential pressure across the transfer line or by the pack pressure. The percent draw was determined to be 41%.

Control 3

The nylon 6,6 copolymer pellets contained 3.0% by weight 5-sulfoisophthalic acid. The nylon pellets were conditioned at 203 degrees C. A set of pigment concentrates was used to make a pigmented yarn known as "Coal," which includes the pigments Channel Black (Black 64), Phthalo Blue (Red shade) also called Blue 61, and Perylene Red (also called Red 60). A multi-feeder was used to add the concentrates at a predetermined set of feed rates.

The spinneret used resulted in a yarn having a trilobal cross-section.

Poor spinning performance was observed, with many filament breaks, and wraps around the feed roll and draw rolls. Very little acceptable yarn could be collected as a result. The percent draw was determined to be 47%.

Example 4

The nylon 6,6 terpolymer pellets contained 1.25% 5-sulfoisophthalic acid and 3.5% (isophthalic acid and methylpentamethylene diamine, in a 1:1 ratio). The nylon pellets were conditioned at 203 degrees C. Pigment concentrates were added to make the pigmented yarn known as "Coal" as described in Control 3. 5% poly(ethylene terephthalate) containing 0.1% anatase TiO2 by weight of the sum of the weights of the polyamide polymer component, the pigment component and the free polyester component was added at the throat of the extruder using a gravimetric feeder.

No difficulty was experienced in spinning the yarn, i.e., there were neither filament breaks nor wraps on feed rolls or draw rolls. There was no significant change in melt viscosity as measured by the differential pressure across the transfer line or by the pack pressure. The percent draw was determined to be 61%.

It is believed to be noteworthy that the nylon terpolymer of Example 4 is generally considered inferior to the copolymer used in Control 3 in terms of percent draw and ability to spin; however, with the additive poly(ethylene terephthalate) as used in Example 4, this polymer turned out to be superior in these respects.

Control 4

A high tenacity unbulked nylon yarn was made. Nylon 6,6 homopolymer pellets were fed at 145 pounds per hour to an extruder, melted and transported through a transfer line to spinnerets. The yarn was prepared with total denier of 470, with 140 filaments (denier per filament of 3.4). The yarn was drawn at a draw ratio of 3.5.

Dark Blue pigment (pigment Blue 61) at 0.9% by weight pigment, along with Red and Channel Black pigments (for a total pigment loading of 1.052% by weight of the yarn) were added through a multifeeder. Poor spinning performance was observed, with many filament breaks, spinneret drips and wraps around the feed roll and draw rolls.

Example 5

The process of Control 4 was used, with the addition of poly(ethylene terephthalate) at a rate of 5% by weight of the sum of the weights of the polyamide polymer component, the pigment component and the free polyester component. The poly(ethylene terephthalate) was added in the form of pellets containing 0.1% titanium dioxide, added via a gravimetric feeder at the throat of a twin screw extruder.

No difficulty was observed in yarn spinning. There were no filament breaks, feed roll wraps or spinneret drips.

Those skilled in the art, having the benefit of the teachings of the present invention, as hereinabove set forth, may effect numerous modifications thereto.

It should be understood that all such modifications lie within the contemplation of the present invention as defined by the appended claims.

What is claimed is:

1. A pigmented polyamide shaped article comprising components:

(i) a polyamide polymer;

(ii) a pigment dispersed in a polymeric carrier, and (iii) about one-half (0.5) to about nine (9) percent free polyester by weight of the components (i) plus (ii) plus (iii).

2. The shaped article of claim 1 wherein the free polyester is present in an amount between about three (3) and about five (5) percent by weight of the components (i) plus (ii) plus (iii).

3. The shaped article of claim 2 wherein the free polyester is selected from the group consisting of poly(ethylene terephthalate), poly(trimethylene terephthalate), poly (tetramethylene terephthalate) and copolymers and blends thereof.

4. The shaped article of claim 3 wherein the polyamide polymer is selected from the group consisting of nylon 6, nylon 6,6 and copolymers and blends thereof.

5. The shaped article of claim 3 wherein the pigment is selected from the group consisting of Phthalo Green, Phthalo Blue, Channel Black, Antimony Chrome Titanate, Anthraquinone, Perylene Red, Cobalt Blue, Lamp Black, Carbozol Violet, Quinacridone, and Indanthrone Blue.

6. The shaped article of claim 3 wherein the polyamide polymer contains an additive in the amount of 0.25% to 30% by weight of the shaped article, the additive being selected from the group consisting 5-sulfoisophthalic acid, isophthalic acid, terephthalic acid, 2-methyl 1,5-pentamethylene diamine and blends thereof.

7. The shaped article of claim 1 wherein the shaped article is a multifilament yarn.

* * * * *